US006212763B1

(12) United States Patent
Newman

(10) Patent No.: US 6,212,763 B1
(45) Date of Patent: Apr. 10, 2001

(54) TORQUE-TURN SYSTEM FOR A THREE-ELEMENT SUCKER ROD JOINT

(76) Inventor: Frederic M. Newman, 1618 W. Dengar, Midland, TX (US) 79705

( * ) Notice: Subject to any disclaimer, the term of this patent is extended or adjusted under 35 U.S.C. 154(b) by 0 days.

(21) Appl. No.: 09/342,564

(22) Filed: Jun. 29, 1999

(51) Int. Cl.[7] ..... B25B 23/14

(52) U.S. Cl. ..... 29/702; 29/407.02; 29/407.03; 29/714; 173/180; 173/181; 73/862.23; 73/862.24; 73/862.25

(58) Field of Search ..... 29/407.02, 407.03, 29/701, 702, 714; 173/176, 180, 181, 182, 183; 73/862.23, 862.24, 862.25

(56) References Cited

U.S. PATENT DOCUMENTS

| | | | | |
|---|---|---|---|---|
| 3,768,573 | * | 10/1973 | Jennings . | |
| 3,973,434 | * | 8/1976 | Smith . | |
| 4,091,451 | | 5/1978 | Weiner et al. . | |
| 4,106,176 | * | 8/1978 | Rice et al. . | |
| 4,176,436 | | 12/1979 | McCombs et al. . | |
| 4,199,032 | | 4/1980 | Weiner et al. . | |
| 4,208,775 | * | 6/1980 | McCombs et al. . | |
| 4,208,919 | | 6/1980 | Motsinger . | |
| 4,210,017 | | 7/1980 | Motsinger . | |
| 4,400,785 | * | 8/1983 | Wallance et al. | 73/862.24 |
| 4,446,745 | | 5/1984 | Stone et al. . | |
| 4,578,642 | * | 3/1986 | Moake et al. . | |
| 4,592,125 | | 6/1986 | Skene . | |
| 4,738,145 | | 4/1988 | Vincent et al. . | |
| 5,245,265 | * | 9/1993 | Clay . | |
| 5,402,688 | * | 4/1995 | Okada et al. | 73/862.23 |
| 5,502,883 | * | 4/1996 | Ohmi et al. | 29/407.02 |
| 5,988,299 | * | 11/1999 | Hansen et al. . | |

FOREIGN PATENT DOCUMENTS

| | | | | |
|---|---|---|---|---|
| 03-054430 | * | 3/1991 | (JP) | 73/862.23 |

OTHER PUBLICATIONS

ITD Automation Catalog, 1997, Auburn Hills, MI.
BETAFSC Advertisement.
Ingersoll–Rand Catalog, 1996, Liberty Corner, NJ "Torque Management Systems".
"Engineered Assembly Process Solutions" Ingersoll–Rand, 1997, Liberty Corner, NJ.
Cooper Power Tools Catalog.
Aimco Catalog, Portland, Oregon.
"Trip Master Computerized Torque Control System" Sales Brochure.
Paul Anthony, Author; "Torque–Turn in Principle and Practice" Petroleum Engineering International, Jul. 1980.
"2000 Series"; American Assembly Tools, Inc; Cleaveland, OH.

* cited by examiner

*Primary Examiner*—S. Thomas Hughes
*Assistant Examiner*—Eric Compton
(74) *Attorney, Agent, or Firm*—Robert J. Harter

(57) ABSTRACT

A sucker rod tool system for oil wells monitors both torque and angular displacement of a three-element sucker rod connection. The tool system engages two sucker rods that are at least partially screwed into opposite ends of a sucker rod coupling. The system, however, does not engage the coupling adjoining both rods. The system determines whether a connection has been properly tightened by sensing the torque and angular displacement of the connection as it is being tightened, and comparing the data to a stored reference set of data or curves. In some embodiments, a properly tightened connection is based upon the number of straight lines that are needed to adequately approximate a plotted curve of the sensed torque versus angular displacement. Tightness of each connection of a string of sucker rods is recorded with reference to each connection's depth within a well to later serve as an aide in diagnosing connection failures. In some cases, the energy required to unscrew a connection is also recorded. In some embodiments, the system automatically determines whether one or both sucker rods of a three-element connection need to be tightened.

14 Claims, 8 Drawing Sheets

70
62
60
146
M
64
50
66
148
61
72
52
56
149
76
73
74
114
174
170
110
R
G
68
TORQUE
78
ROTATION
176
71
102
112
149
144
144'
131
130
132
134
164
14'
14a'
14b'
14c'
14d'
128
58
129

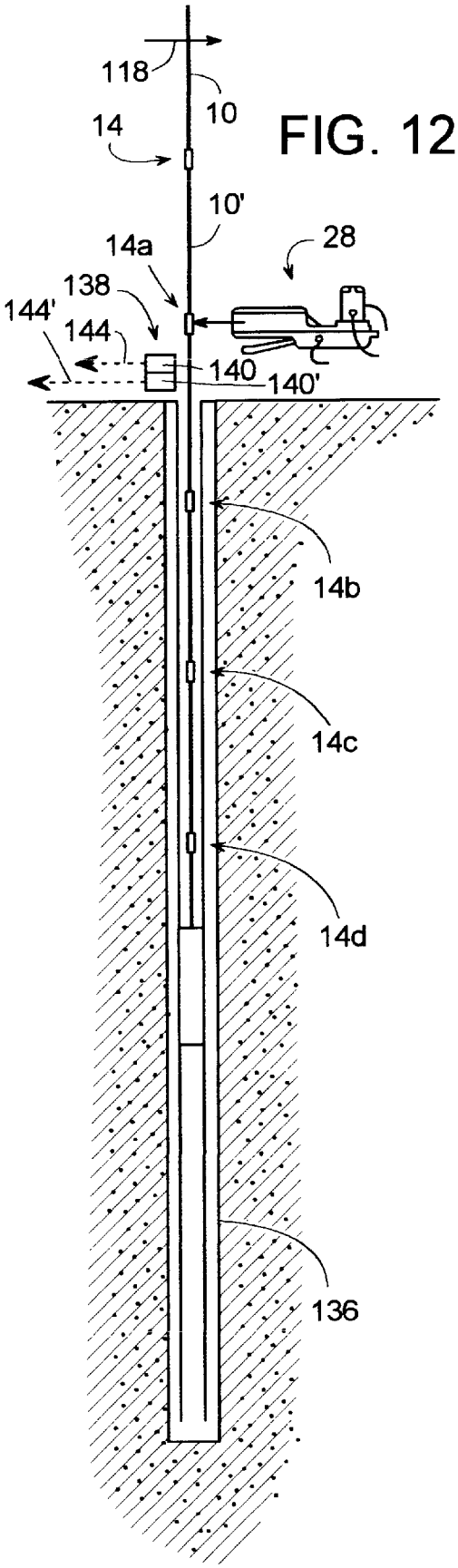
FIG. 12
FIG. 13
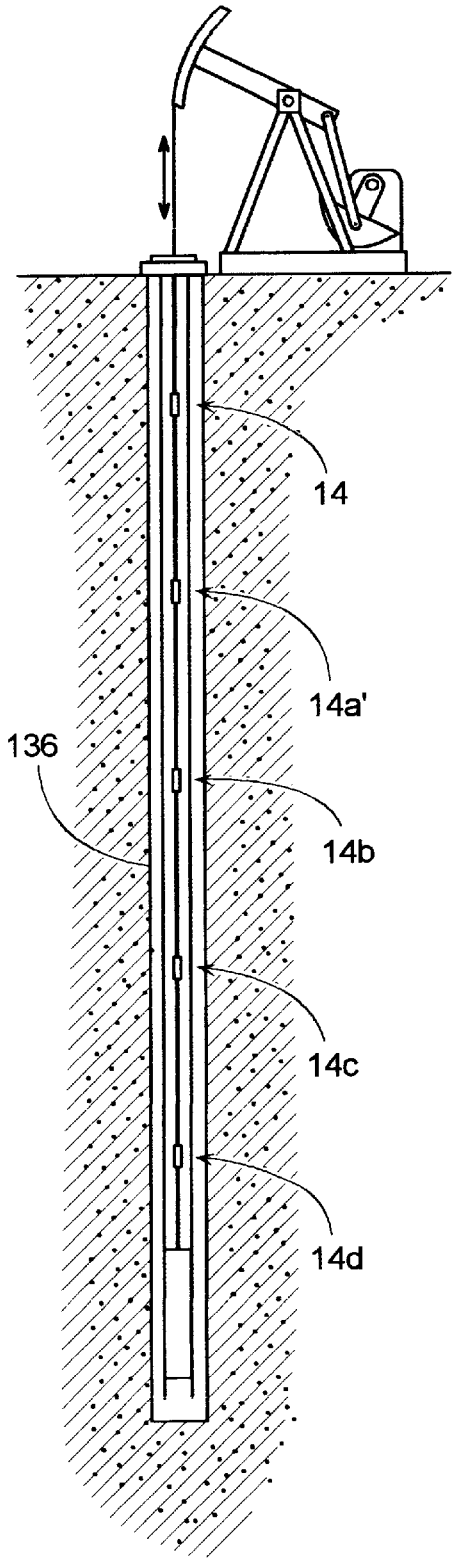

TORQUE-TURN SYSTEM FOR A THREE-ELEMENT SUCKER ROD JOINT

BACKGROUND OF THE INVENTION

1. Field of the Invention

The subject invention generally pertains to sucker rods of sucker rod pumps (typically used in oil wells) and more specifically to a tool system for assembling and disassembling sucker rods.

2. Description of Related Art

Oil wells and many other types of wells often include a sucker rod pump for pumping oil or other fluid from deep within a well bore to the surface of the earth. A sucker rod pump is a reciprocating piston/cylinder type pump situated at the bottom of a long string of tubing that conveys the pumped fluid upward to the earth's surface. An oscillating drive at ground level is coupled to raise and lower the pump's piston by way of long string of sucker rods that may extend over 10,000 feet through the interior of the tubing. The string of sucker rods is comprised of individual solid rods of about 0.5 to 1.125 inches in diameter and about 25 to 30 feet long. Each sucker rod has an axial shoulder and male threads at each end that allow the rods to be tightly connected end-to-end by way of female threaded rod couplings (also referred to as boxes). The couplings also serve as a wear surface that protects the more expensive sucker rod from wear as the string of sucker rods may slide up and down along the interior of the tubing for millions of cycles over its lifetime.

Properly tightening each threaded joint of a string of sucker rods is critically important, as even a single improperly tightened joint can lead to a premature separation, fatigue cracking, or complete breakage of the string. This not only interrupts the ongoing operation of the well, but repairing a string of sucker rods is very expensive, due to its inaccessibility. Usually the entire string of sucker rods is removed from the well bore to repair a single joint. For a 10,000-foot string of 25-foot sucker rods, there are 800 threaded joints. Thus, a reliable system is needed to properly tighten every single one.

Today, power rod tongs are possibly the most common tools for assembling and disassembling a string of sucker rods. Conventional tongs, such as those provided by BJ-Hughes Machinery of Houston, Tex., includes two sets of jaws: one set being driven to rotate relative to the other. To assemble a new joint, a sucker rod is first manually screwed band-tight into each end of a coupling. The rod tong is positioned to engage one set of tong jaws with mating flats of one sucker rod, and the other set of jaws with mating flats of the other sucker rod. This places the coupling generally between, but spaced apart from, the two sets of jaws. Actuating the tong rotates one rod relative to the other, so that both rods screw tightly into the coupling generally at the same time. As the connection tightens, the tong eventually stalls at a torque or pressure preset by the operator. When the tong stalls, the operator assumes that the connection is properly torqued with the proper preload. Thus the operator manually stops the tong and disengages it from the sucker rods.

Controlling torque alone, however, generally disregards several factors that can result in an improperly tightened joint, even though the target torque was reached. Even with sufficient torque, inadequately preload of the joint can result from dry threads, dirt (on the threads or axial faces of the coupling or rod shoulders), galling, and even a cross-wind that causes a rod to sway and bind. Over tightening or excess preload can occur when a tong is not properly calibrated to account for various characteristics of the tong. By monitoring and controlling torque alone, a joint with worn or partially stripped threads may get fully torqued and accepted as a proper joint.

In some instances, monitoring the angular displacement or extent to which one element of a joint is turned relative to another has been successfully applied to achieve a properly tightened joint. When tightening tubing, for example, some tubing tongs include means for monitoring the angular displacement of one tubing section being screwed into an adjoining pipe coupling. This, however, is a simple two-element joint comprising one section of tubing and one pipe coupling. Power tubing tongs with serrated teeth (similar to those of a pipe wrench) can simply bite into the two adjoining elements and control the extent of their relative rotation.

With a three-element joint, such as two sucker rods with a coupling interposed therebetween, such a conventional angular displacement tightening process is impractical for several reasons. Sucker rods are subjected to a tremendous axial load, especially those near the top of the string, as they must support the all the other rods hanging below them. In addition, the raising and lowering of the sucker rods contributes an additional cyclical load that has been known to lead to fatigue cracking at the joints. Consequently, it is desirable to avoid the use of serrated tong jaws whose bite may create detrimental stress concentrations at the joint. Moreover, since many sucker rods have smoothly polished ends to minimize stress concentrations and often have a relatively delicate plastic coating to resist corrosion, it is important to properly engage only the flats of the sucker rods with correspondingly flat jaws as found on conventional rod tongs. This limits the available points of engagement to only certain locations on the sucker rods and restricts one from gripping the rod coupling itself By not biting into the rod coupling of a three-element joint, there becomes a question as to whether one or both rods are being tightened to the coupling.

To settle the question of how many rods are being tightened at one time, a line can be manually scribed on the periphery of the coupling and each rod, and the circumferential displacement of the line can be measured as the three element joint is torqued. However, such a method may only be practical in a test or experimental setting and would be much too time consuming to apply on a regular basis at a field setting. Further, before scribing the line, the shoulder point (i.e., the point at which the shoulders of the sucker rods abut the axial face of an adjoining coupling) would need to be determined, which is not always easy to do accurately.

Sometimes, a properly tightened sucker rod joint can fail after being subjected to averse operating conditions at the well. For example, if a string of sucker rods are driven down faster than the speed at which the rod tends to fall, the string of sucker rods will go into compression at each down stroke. This, of course, will cause the string to bow and thus repeatedly strike the side wall of the tubing. Other dynamic problems include sucker rod resonance and fluid pound or fluid hammering. When such problems causes a joint failure, there becomes a question as to whether the joint was ever properly tightened in the first place. In some cases, joint failures are confined to a particular depth range of the well bore. However, without reliable records of joint make-up during assembly and joint break-out during disassembly, many of the clues that could identify the cause of a particular problem are never discovered.

SUMMARY OF THE INVENTION

To overcome the current limitations of assembling or disassembling a string of sucker rods, it is an object of the invention to monitor both torque and rotational displacement of a three-element joint comprising two sucker rods screwed into opposite ends of a rod coupling.

A second object is to reliably identify a shoulder point by statistically analyzing a group of data points as opposed to relying on threshold being reached by just a single data point or single incremental change from one data point to another, thereby minimizing the likelihood of a single aberrant data point triggering the identification of a false shoulder point.

A third object is to determine whether a sucker rod connection was properly tightened by measuring the breakout energy required to unscrew the connection.

A fourth object is to determine whether a sucker rod connection is properly tightened or preloaded by comparing the connection's actual measured torque-turn curve to a stored torque-turn curve having upper and lower acceptance limits.

A fifth object is to create a record of tightness versus well depth for each connection of a string of sucker rods, whereby the record can be referred to later in analyzing a depth related failure of a sucker rod connection.

A sixth object is to create of record of tightness (during the original installation of a string of sucker rods) and breakout energy (upon subsequent removal of the string of sucker rods), and relating the data to the well depth of each sucker rod connection, whereby the record can be referred to later in analyzing a depth related failure of a connection.

A seventh object is to position a coupling sensor at a location where it can sense when a sucker rod connection is being inserted or removed from the well, wherein the sensor can aide in creating a record of the tightness versus depth and/or tightness versus breakout energy of each sucker rod connection of the well.

An eighth object is to provide a coupling sensor that distinguishes between a sucker rod connection entering the well and one that is exiting.

A ninth object is to plot the applied torque versus rotation of a sucker rod connection, curve-fit straight lines to the plot, and then determine whether the connection is acceptable based on the number of straight lines that are needed to approximate the plotted data while maintaining a predetermined minimum standard deviation of the plotted data points relative to the straight lines.

A tenth object is to provide an operator with immediate visual and/audio feedback of a sucker rod tightening system that monitors both applied torque and angular rotation of a sucker rod connection during assembly or disassembly.

An eleventh object is to provide a sucker rod tightening system that automatically determines whether one or two sucker rods needs tightening of a three-element sucker rod connection.

A twelfth object is to provide a sucker rod tightening system that after tightening a connection provides a dwell period, wherein the system continues to tighten the joint for a brief moment to compensate for binding in the connection caused by one of the sucker rods swaying in the wind.

A thirteenth object is to provide a sucker rod tightening system that determines the relative rotation of a sucker rod connection by sensing the number of passing gear teeth of a drive unit creating the rotation, wherein the rotational speed of the gear exceeds that of the sucker rod to improve the resolution of measuring the sucker rod's rotation.

A fourteenth object is to provide a sucker rod tool system that tightens a three-element sucker rod connection while avoiding tool engagement with a rod coupling interposed between two sucker rods, thereby avoid creating stress-concentrating tool marks on the coupling.

A fifteenth object is to provide a sucker rod tool system that compares sucker rod assembly records with disassembly records, whereby the tool system is used over a period of time with repeated assembly and disassembly of the same connection to help diagnose connection failures.

A sixteenth object is to monitor peak breakout torque of sucker rod joints, so that torque values outside an acceptable limit can serve as a clear warning of potential spot corrosion on the threads, which may otherwise go undetected.

These and other objects of the invention are provided by a novel sucker rod tool system that includes a sensor and a control to monitor both torque and angular displacement of a three-element connection, wherein the system engages two sucker rods that are at least partially screwed into opposite ends of a sucker rod coupling.

BRIEF DESCRIPTION OF THE DRAWINGS

FIG. 12 is a cross-sectional view of a well bore, wherein a string of sucker rods are being assembled and installed in the well.

FIG. 13 is the same cross-sectional view of the well bore of FIG. 12, but with the string of sucker rods installed and operating.

DESCRIPTION OF THE PREFERRED EMBODIMENT

Figure 1:
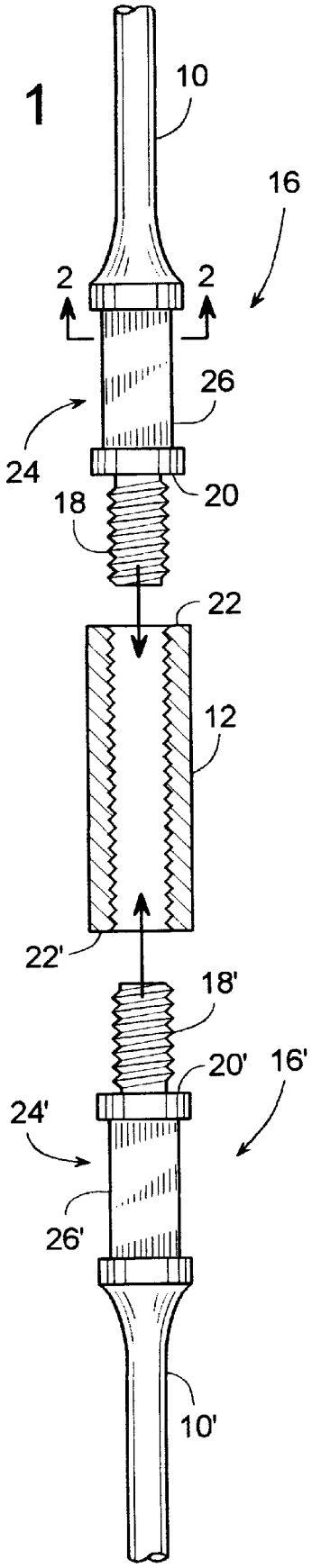
FIG. 1 is side view of a three-element sucker rod connection about to be assembled.
Figure 2:
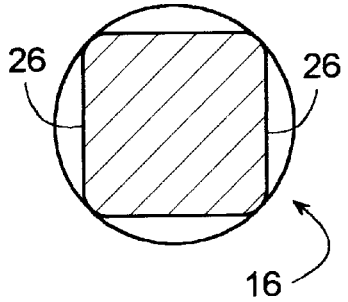
FIG. 2 is a cross-sectional view taken along line 2—2 of FIG. 1.
Figure 3:
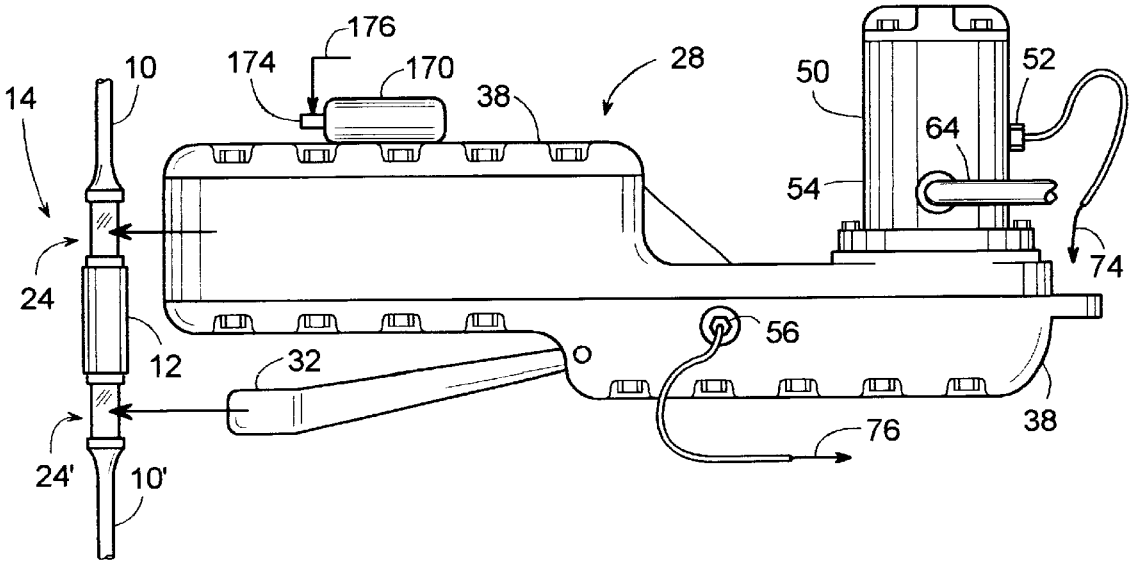
FIG. 3 is a side view of a three-element sucker rod connection about to be tightened by a tong.
Figure 4:
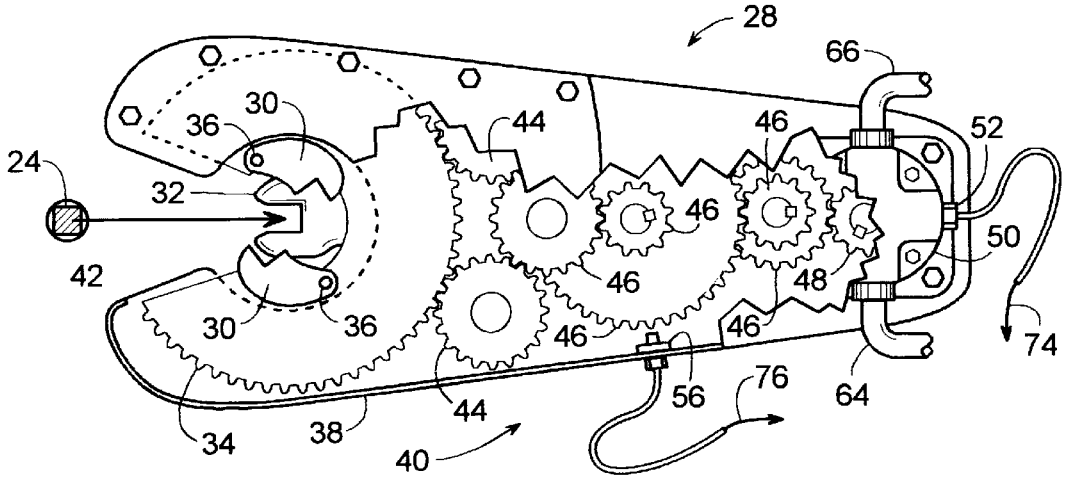
FIG. 4 is a top view of a tong looking through its outer housing.
Figure 5:
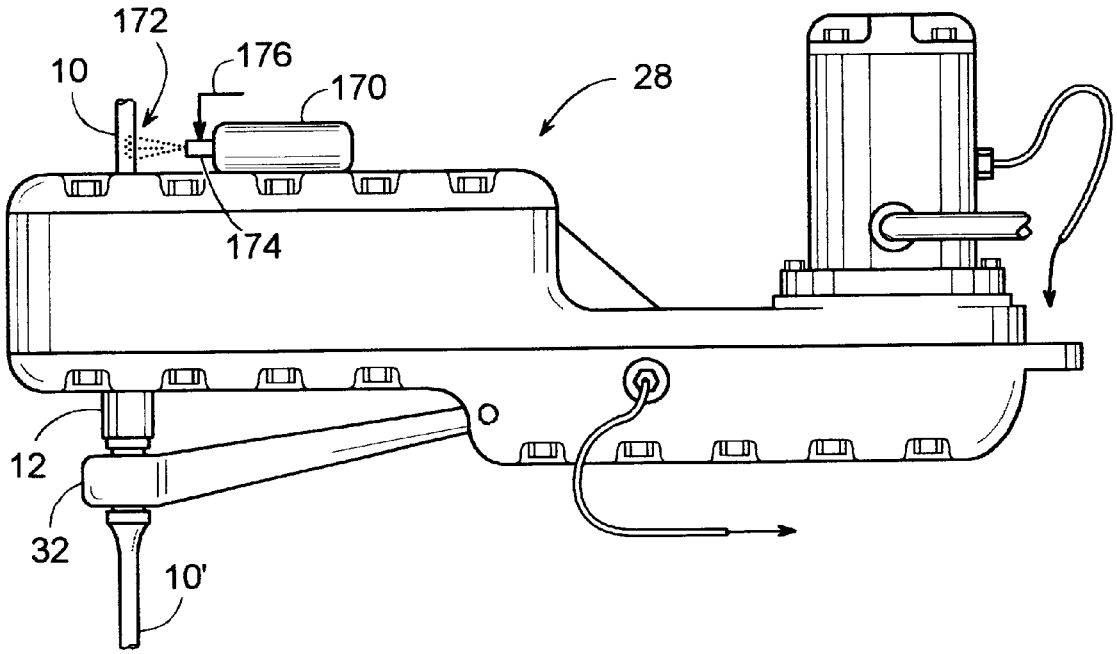
FIG. 5 is a side view of a tong engaging two interconnected sucker rods.
Figure 6:
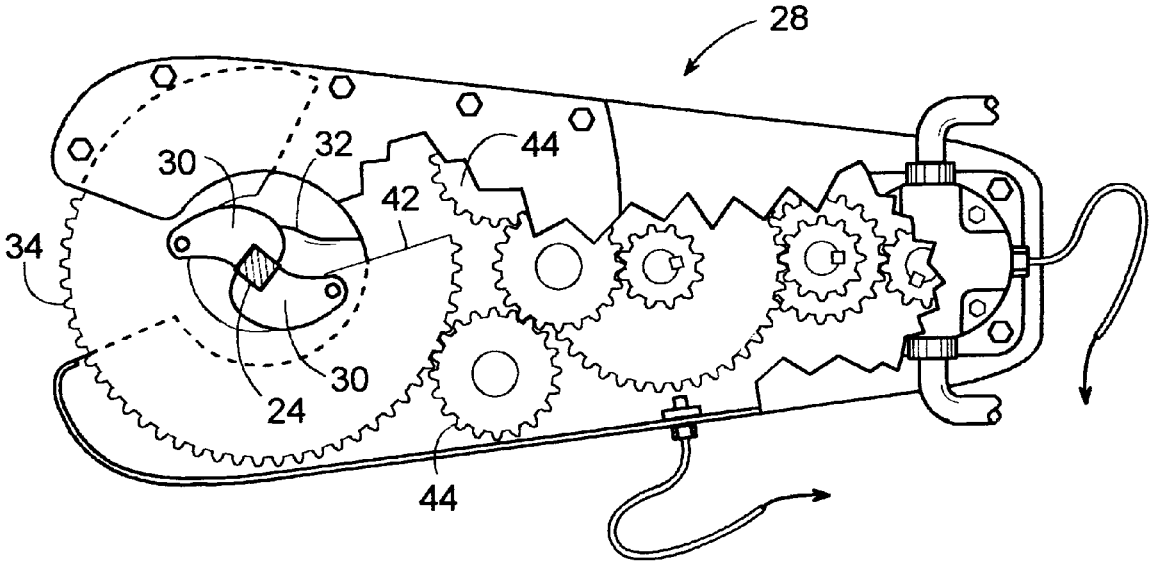
FIG. 6 is a top view of a tong's jaws engaging and rotating the square drive head of a sucker rod, wherein the square drive head is shown as a top cross-sectional view.

Two conventional sucker rods 10 and 10' about to be screwed into opposite ends of a rod coupling 12, are shown in FIGS. 1 and 2. Sucker rods 10 and 10' and coupling 12 are three elements that once assembled comprise a three-element connection 14, as shown in FIG. 3. Each sucker rod 10 and 10' respectively includes a rod end 16 and 16' with a threaded pin 18 and 18' that screws into coupling 12, a shoulder 20 and 20' adapted to tightly abut up against an axial face 22 and 22' of coupling 12, and a square drive head 24 and 24' that provides a set of flats 26 and 26' suitable to be engaged by a tool used for torquing and tightening the sucker rods. The term, "tightening" refers to rotating one element relative to an adjoining element so that their relative movement causes them to screw into each other. The term, "torquing" refers to applying a torque to an element, wherein the element may or may not necessarily move.

One example of a tool used for simultaneously torquing sucker rods 10 and 10' that are screwed into coupling 12, is tong 28 of FIGS. 3–6. Tong 28 includes a rotational set of jaws 30 adapted to engage head 24 and a fixed set of jaws 32 (back-up wrench) for engaging head 24'. Jaws 30 are pivotally attached to a gear segment 34 (outer ring assembly) by way of pins 36. Pins 36 allow jaws 30 to pivot in and out of engagement with head 24 (FIGS. 6 and 4 respectively), while gear segment 34 renders jaws 30 rotational relative to a tong housing 38 from which fixed jaws 32 extend. Although housing 36 is actually made of cast iron, housing 38 is illustrated as a see-through housing to more clearly illustrate a drive unit 40 (gears, motor, etc.) of tong 28. Gear segment 34 includes an opening 42 to receive and release rod 10, so two drive gears 44 are used to keep gear segment 34 engaged with at least one drive gear 44 at all times. A set of speed reducing gears 46 couple drive gears 44 to an output pinion gear 48 of a hydraulic motor 50 (motor 50 could alternatively be electric or pneumatic). Thus, motor 50 turning pinion 48 rotates gear segment 34 at a reduced speed to provide jaws 30 with bit sufficient torque to tightly screw rods 10 and 10' into coupling 12 to make-up the three-element connection 14. To disassemble or unscrew at least one sucker rod 10 or 10' from coupling 12, the rotational direction of motor 50 is simply reversed.

To ensure that the three-element connection 14 is properly tightened, i.e., shoulders 20 and 20' of rods 10 and 10' are properly preloaded up against axial faces 22 and 22'of coupling 12, a conventional BJ Hughes tong is modified to create tong 28, which includes transducers that sense features or properties indicative of torque and the angular displacement of jaw 30 relative to jaw 32. In one embodiment, for example, tong 28 includes a pressure transducer 52 sensing the incoming oil pressure of hydraulic motor 50. The pressure is sensed at a point directly within housing 54, as sensing the oil pressure just outside of housing 54 (e.g., within the hydraulic hose feeding motor 50) was found to be a surprisingly inaccurate indicator of the actual torque. In some embodiments, two individual pressure transducers 52 are connected at separate locations to sense hydraulic pressure for either tightening or disassembling connection 14. To sense the angular displacement (also known as circumferential displacement or turns) of jaws 30, a transducer 56, such a DZH series Hall effect sensor by Electro Corportation of Sarasota, Fla., senses a magnetic disturbance created by each passing ferro-magnetic tooth of one of the gears (e.g., 34, 44, 46 or 48) coupled to rotate jaws 30.

Figure 7:
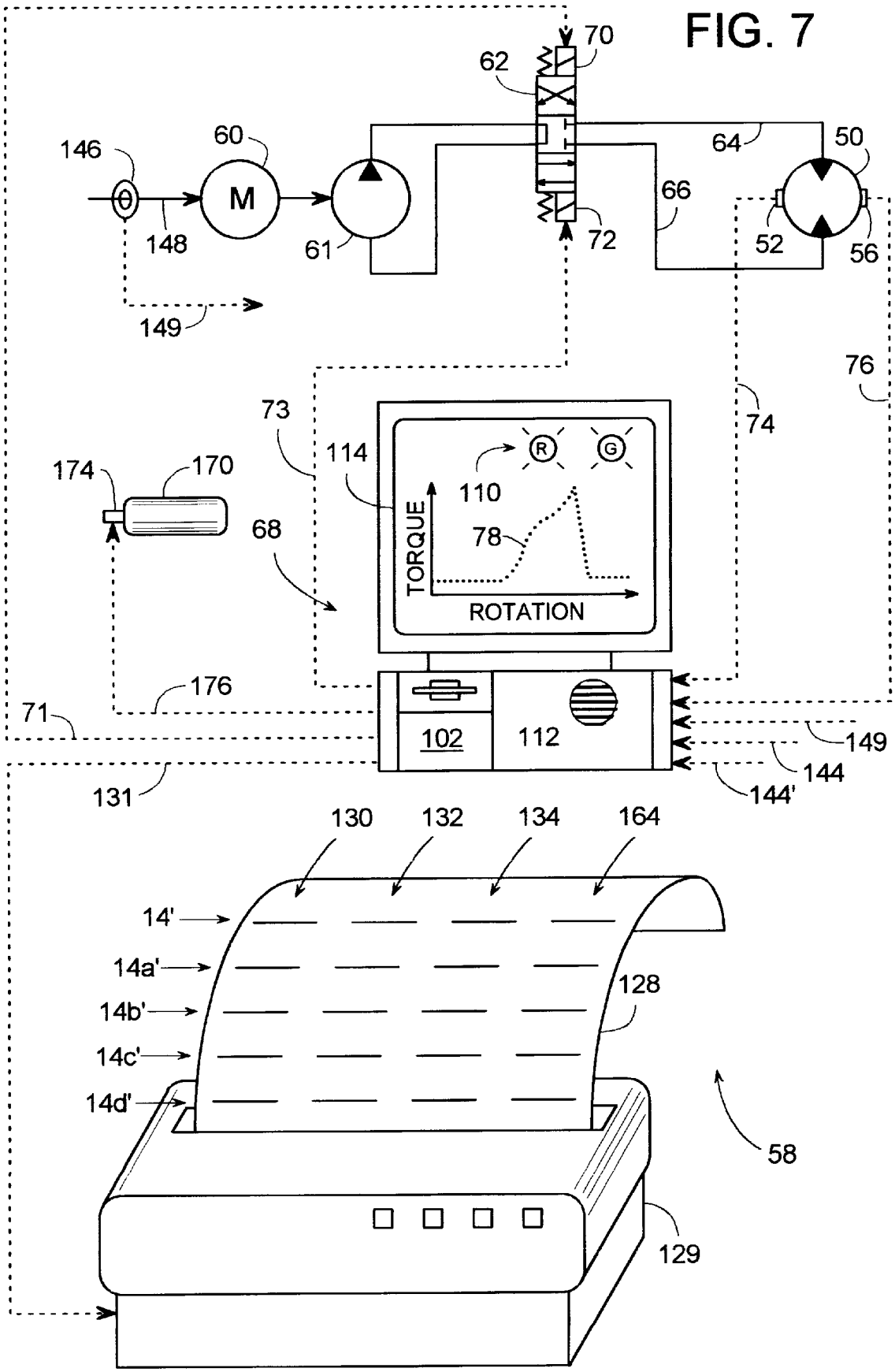
FIG. 7 is a schematic view of a sucker rod tool system according to some embodiments of the invention.

Tong 28 and transducers 52 and 56 are integrated into a sucker rod tool system 58, as shown in FIG. 7. Here, a hydraulic pump 61, driven by a motor 60 (e.g., an electric or diesel prime mover), delivers high-pressure hydraulic oil through a solenoid actuated directional valve 62 whose position determines whether tong motor 50 is stopped or driven in a forward or reverse rotational direction. Lines 64 and 66 couple motor 50 to valve 62. A control 68 determines the position of valve 62 by selectively energizing solenoids 70 and 72 (via output signals 71 and 73) in response to feedback signals 74 and 76 provided by transducers 52 and 56. With tong 28 engaging rods 10 and 10', feedback signal 76 represents the angular displacement of rod 10 relative to rod 10' and signal 74 varies as a function of the torque applied to rods 10 and 10'. Control 68 is schematically illustrated to represent any one of a variety of programmable or dedicated control circuits including, but not limited to, a microprocessor associated with appropriate memory and input/output boards, a microcomputer, computer, or PC; a PLC (programmable logic controller); and a myriad of hard-wired electrical circuits comprised of discrete electrical components and/or solid-state integrated circuits.

When a long string of sucker rods are removed from a well bore being serviced, the rods are often kept in groups of three by separating only every third connection. And for every connection that is separated, typically, the coupling (e.g., coupling 12) is left tightly screwed onto one of the sucker rods (e.g., rod 10'). Thus, when the string of rods is reinstalled, the make-up of each connection 14 usually involves just tightening one rod (e.g., rod 10) to coupling 12, as the other one (rod 10') should still be tightly screwed into coupling 12.

To make-up connection 14 when one rod 10' is already tightly screwed into coupling 12, the loose rod 10 is first manually screwed into coupling 12 hand-tight. Tong 28 is slipped over connection 14 with jaws 30 and 32 engaging flats 26 and 26' respectively. In response to a manual or automatic trigger, control 68 energizes solenoid 72 to shift valve 62, such that jaws 30 of tong 28 starts rotating. This simultaneously torques both rods 10 and 10' in opposite directions, which screws or tightens rod 10 further into coupling 12 (rod 10' is already tight). Control 68 samples the torque feedback signal 74 for each pulse received from rotational feedback signal 76.

Figure 8:
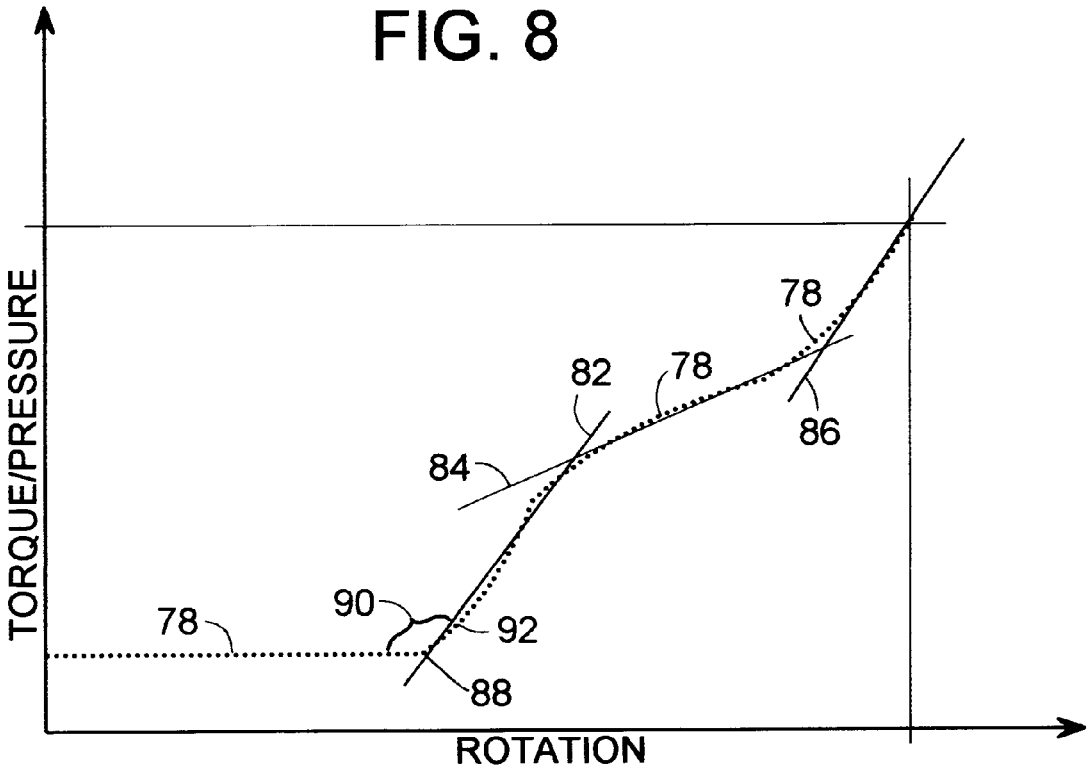
FIG. 8 is a graph showing torque or pressure versus angular displacement of a properly tightened connection.

Referring to FIG. 8, the most recently sampled data 90 of four or more torque readings (ten in a preferred embodiment) are statistically analyzed by control 68 to determine whether data 90 encompasses a shoulder point 88 prior to the most recent torque reading 92. The shoulder point is that point at which shoulder 20 of rod 10 has firmly abutted axial face 22 of coupling 12 and preload is starting to occur. In one embodiment, the shoulder point is the intersection of two best-fitting straight lines passing through the recently sampled group of points, wherein the angle formed by the two lines exceeds a predetermined minimum. In another embodiment, a single line is fitted to the recently sampled group of points, and the shoulder point is one of the earlier of the points when the slope of the line exceeds a predetermined minimum. Identify a shoulder point by statistically analyzing a group of data points 90 as opposed to relying on a threshold being reached by just a single data point or single incremental change from one data point to as another, minimizes the likelihood of a single aberrant data point triggering the identification of a false shoulder point.

After the shoulder point has been identified, control 68 allows jaws 30 to continue rotating a predetermined angular displacement by counting a predetermined number of pulses from rotational feedback signal 76. For example, in one embodiment, the predetermined number of pulses is 57 to provide rod 10 with about 23 degrees of angular rotation, as 893 gear teeth will pass by transducer 56 for every complete 360 degree rotation of jaws 30. These numbers, of course, can vary widely, depending on the specific design of the tong, to which gear the transducer is aligned; and the size, design, and desired preload of the rod connection Once rod 10 rotates the predetermined amount past the shoulder point, control 68 shifts valve 62 to its center position to stop tong 28 and release sucker rods 10 and 10'.

Figure 9:
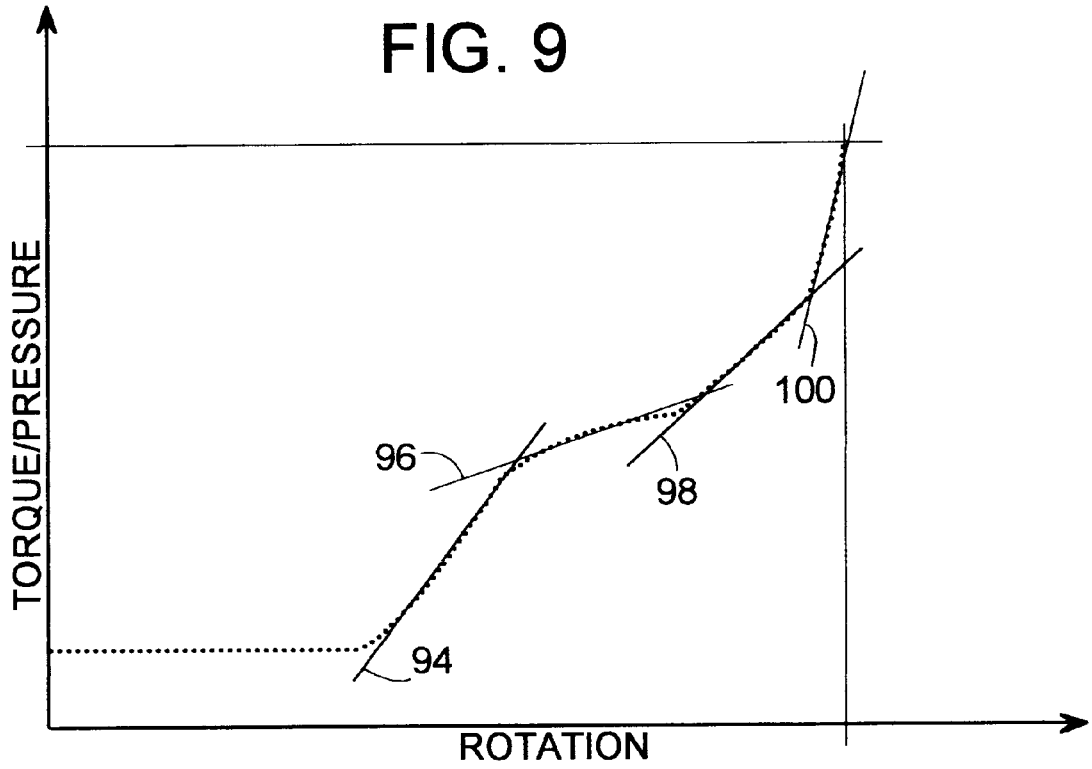
FIG. 9 is a graph showing torque or pressure versus angular displacement of an improperly tightened connection

Evaluating the sampled torque feedback data with reference to the angular displacement of jaws 30 allows control 68 as well as an operator and others to determine whether the make-up of connection 14 is acceptable. In FIG. 8, for example, upon plotting sampled torque feedback 74 as a function of angular displacement 76, the result reveals a collection of data points 78 through which several straight lines 82, 84 and 86 of various distinct slopes can be readily fitted. By experimentation, it has been found that when a collection of data points (beyond a shoulder point 88) can be closely approximated with three distinct lines, the tightness of the connection is generally good. The lines can be manually fitted or created by a computer program. For example, by trial and error a program could determine the number of straight lines that are required to approximate the actual data without exceeding a predetermined standard deviation of a group of data points in relation to a line fitted to them. Three lines could be the predetermined accepted number, more or less than three might indicate defective threads or over tightening, as illustrated by lines 94, 96, 98 and 100 of FIG. 9.

It should be noted that various features of the curves, such as the shoulder point and various slopes are sometimes more visually identifiable if the measured data (e.g., data points 78) is first enhanced by applying the data to an exponential function. In one embodiment, for example, the plotted torque "T" is a feature-enhanced function of the pressure "T" (as sensed by transducer 52) as follows:

$$T=(50)(1-e^{((P-Pavg)/P)})$$

The term, "Pavg" is the average pressure of a group of the most recently sampled data of four or more torque readings (ten in a preferred embodiment, as mentioned earlier). Since Pavg continues to change with every additional data reading, Pavg is sometimes referred to as a rolling average. The term, "e" equals 2.718.

Figure 10:
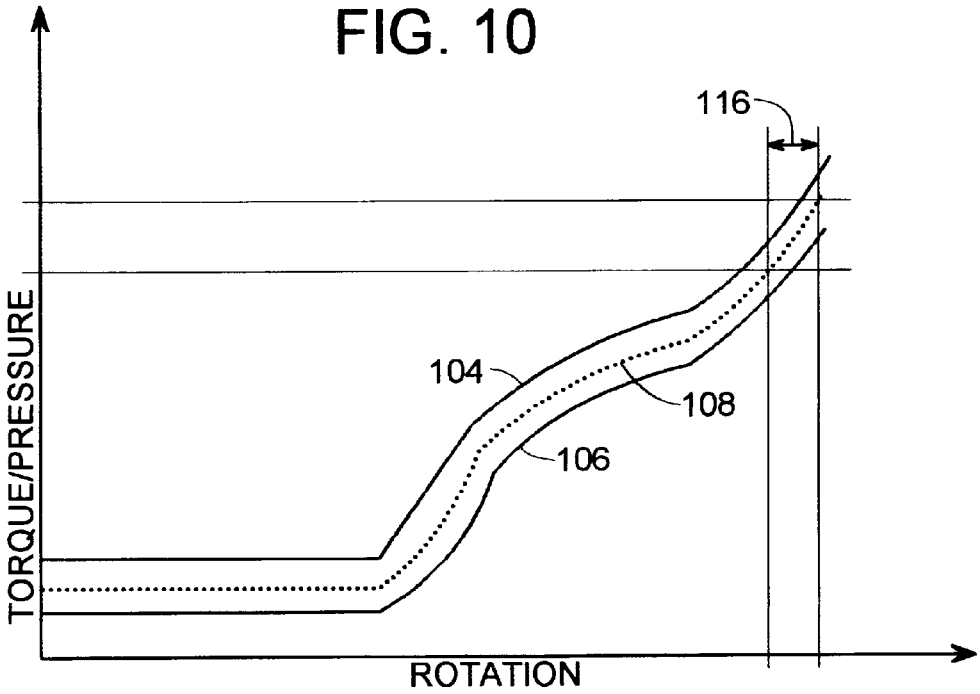
FIG. 10 is a graph showing actual and reference curves of torque or pressure versus angular displacement.

In another embodiment, control 68 includes a memory 102 that stores an upper target function 104 and a lower target function 106, as shown in FIG. 10. Memory 102 is schematically illustrated to represent the wide variety of forms that it can assume, which include, but are not limited to, a hard drive of a computer; a floppy disc; a CD (compact disk); ZIP drive/cartridge, an electronic chip such as RAM EPROM, or EEPROM and variations thereof; and magnetic tape. In this example, control 68 repeatedly samples torque feedback signal 74 and rotational feedback signal 76 with reference to each other to create an actual function 108. Control 68 then determines whether the three-element connection 14 is properly tightened by comparing the actual function 108 to the upper and lower target functions 104 and 106. If the actual function 108 lies within the upper and lower target functions, then connection 14 is considered to be properly tightened.

Regardless of how the results of a connection is evaluated for appropriate tightness, communicating the results immediately to an operator torquing the connections can provide valuable feedback. Such operator feedback would allow an operator to catch an improperly tightened connection before it is lowered into the well. The feedback could assume a variety of forms including, but not limited to, a visual red/green light 110, an audio alarm 112, and/or displaying the transducer sensed data in graphical form on a conventional computer monitor 114, as shown in FIG. 7.

For the embodiment of FIG. 10, control 68 also provides a dwell period 116 of about five seconds or less. During that time, drive unit 40 urges jaws 30 to continue rotating a predetermined period of time after feedback signal 74 or 76 has indicated that connection 14 has been properly tightened. Dwell period 116 compensates for wind that may be exerting a cross-load 118 (FIG. 12) upon upper sucker rod 10 as it is being tightened. Such a cross-load may cause rod 10 to sway, which in turn could cause some binding in connection 14. Thus, a short period of additional torque may be beneficial in overcoming the binding to allow properly preloading connection 14 or 14*a*.

Figure 11:
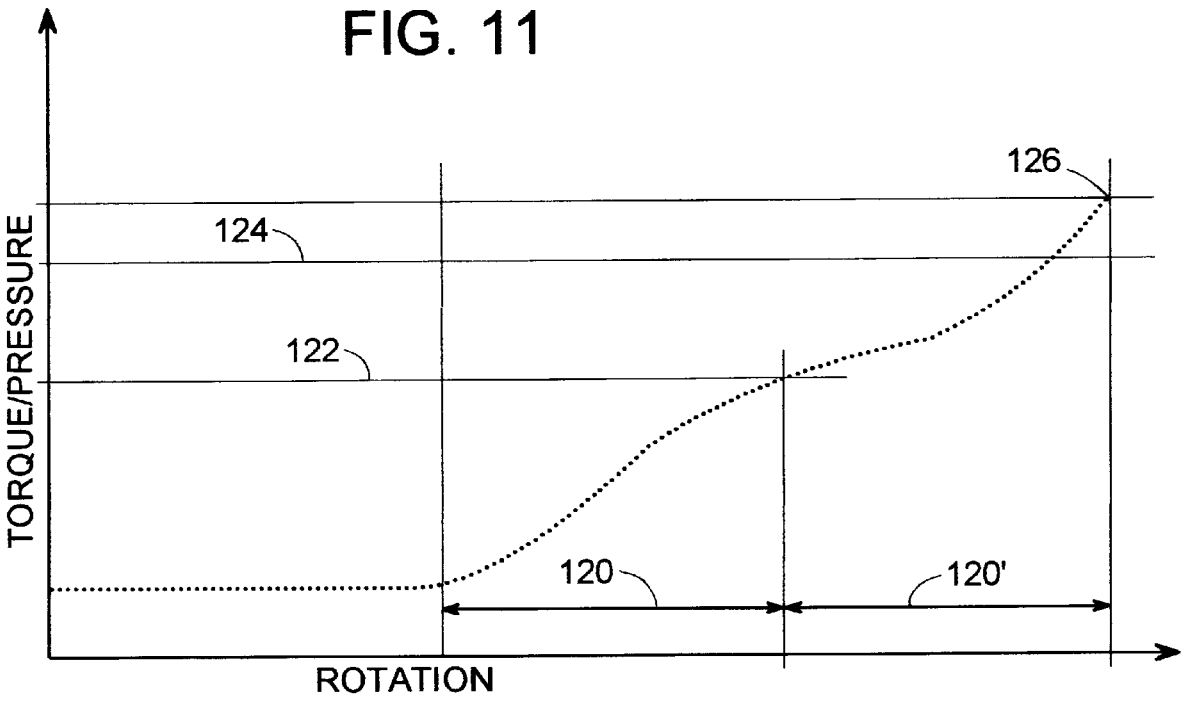
FIG. 11 is a graph showing torque or pressure versus angular displacement of a connection, wherein two sucker rods were tightened to a coupling at generally the same time.

In the make-up of some connections, both sucker rods 10 and 10' need to be tightened into coupling 12. This situation can occur when installing new rod couplings, new sucker rods, or replacing an entire string of sucker rods. In these situations, two sucker rods 10 and 10' can be manually screwed into coupling 12 hand-tight. Tong 28 is then used to both torque and tighten both sucker rods 10 and 10' at generally the same time. Referring to FIG. 11, control 68 begins by assuming that only one rod needs tightening. So after reaching the shoulder point, where both sucker rods 10 and 10' abut opposite faces of coupling 12, tong 28 rotates rod 10 relative to rod 10' the predetermined distance of 23 degrees (dimension 120), which is an appropriate amount if only one rod needs tightening (i.e., the other rod had already been tightened previously). However, since both rods need to be tightened in this case, the actual torque at this point (point 122), as sensed by pressure transducer 52, is much lower than expected. Upon sensing that the actual pressure or torque is below a predetermined minimum 124, control 68 concludes that both rods 10 and 10' need tightening. Thus, control 68 commands tong 28 to rotate an additional predetermined distance of 23 degrees (dimension 120') to reach a final point of tightness at a point 126.

When assembling and installing a long string of sucker rods, as shown in FIGS. 12 and 13, a record of tightness and corresponding well depth location for each connection can be a valuable aide in determining a depth related joint failure. Such a record can be in the form of data stored in memory 102 and/or in the form of a printout 128 from a printer 129 driven by control 68 via signal 131, as shown in FIG. 7. Printout 128 can assume a wide variety of formats, including, but not limited to, alphanumerical or graphical. In one example, printout 128 provides a spreadsheet format displaying a column of well bore depth 130, torque 132 (e.g., pressure), and angular rotation 134 (e.g., number of teeth). Depth 130 can be in terms of actual distance in feet or simply a numerical sequence in which the connections 14, 14*a*, 14*b*, 14*c* and 14*d* were installed. Although tightness in this example is recorded and displayed as both torque 132 and angular rotation 134, just one or the other could be recorded alone to indicate a quality of tightness.

To aide in keeping track of which connection ends up at what depth within a well bore 136, a coupling sensor 138 is positioned detect the presence of a connection 14 moving in or out of well bore 136. Control 68 relies on feedback from sensor 138 to match a connection's tightness to its final depth within well bore 136. Although sensor 138 could be any one of a wide variety of available sensors, in one embodiment, sensor 138 includes two Hall effect proximity sensors 140 and 140' that each provides a feedback signal 144 and 144' to control 68. With two sensors, one above the other, control 68 is able to determine whether a connection 14 is entering or leaving well bore 136 based upon which feedback signal 144 or 144' is received first. This becomes especially useful in avoiding confusion when a connection is lowered into well bore 136, but then immediately pulled back out to settle a question of the connection's tightness.

Figure 14:
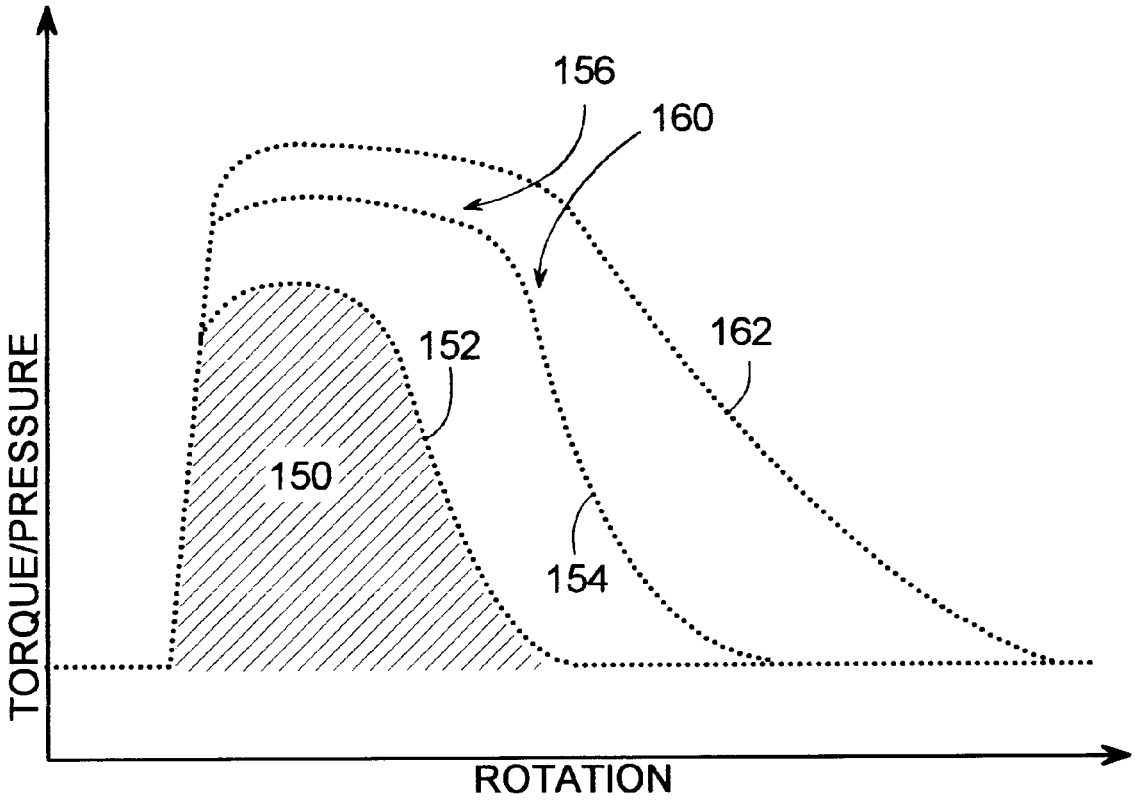
FIG. 14 is a graph showing three curves of torque or pressure versus angular displacement of separate sucker rod connections being unscrewed, wherein the area under the curves indicate the work required to unscrew each connection.

Another useful diagnostic tool is to measure a connection's breakout energy, i.e., the work it takes to at least partially unscrew a sucker rod 10 from coupling 12. A rough indication of the breakout energy can be derived by having a sensor 146 (FIG. 7) measure the electrical current 148 being delivered to motor 60. In some cases, motor 60 is a diesel engine. Thus, a preferred indication of the breakout energy is derived by effectively integrating an area 150 under a torque-rotation curve 152, as shown in FIG. 14. Curve 154 reflects a connection that was properly tight. An upper, generally flat portion 156 of curve 154 is where the shoulder of a tight, preloaded rod is unloading from the face of a coupling, while section 160 is where the rod is separated from the face of the coupling, but is continuing to unscrew. The more section 160 is horizontal, the tighter the threads. An excessive amount of breakout energy, as indicated by curve 162, suggests an over-torqued connection or galled threads. Curve 152 indicates an under-torqued connection. However, for curve 152 the connection may have been properly torqued originally, but was loosened by an adverse operating condition of the well. Consequently, there is a benefit to recording both the original tightness and subsequent breakout energy for each connection, and associating the data with the connection's depth within the well. Printout 128, of FIG. 7, is such a record, wherein column 164 lists the breakout energy of each connection 14–14*d*. Rows 14', 14*a*', 14*b*', 14*c'* and 14*d'* correspond to connections 14, 14*a*, 14*b*, 14*c* and 14*d* respectively.

In some embodiments, a marker 170 (e-g., a sprayer, gun, etc.) can tag or mark connection 14 when the unscrewing torque is beyond a predetermined acceptable range, i-e., too loose or excessively tight, as determined by transducer 52. For example, if connection 14 is too loose, marker 170 could apply a fault-mark 172 by spraying or squirting a colored fluid (e.g, paint, ink, or a fluidized powder) on rod 10, 10' and/or coupling 12. Other examples of fault-mark 172 would include, but not be limited to a clip (metal or plastic), a ribbon, or some other type of band that could attach to connection 14. Marker 170 can be made responsive to transducer 52 in any one of a variety of ways. For example, marker 170 in the form of a spray paint canister includes a discharge solenoid valve 174 actuated by an output signal 176 from control 68, which in turn is responsive to feedback signal 74. After a string of sucker rods are disassembled, individual connections that have been marked can be inspected more closely to determine the cause or severity of any joint problem.

Although the invention is described with reference to a preferred embodiment, it should be appreciated by those skilled in the art that various modifications are well within the scope of the invention. Therefore, the scope of the invention is to be determined by reference to the claims that follow.

I claim:

1. A sucker rod tool system adapted to simultaneously torque two threaded joints of a three-element connection, wherein said three-element connection includes a first sucker rod and a second sucker rod screwed into opposite ends of a threaded coupling, wherein said first sucker rod includes a first set of flats and a first shoulder and said second sucker rod includes a second set of flats and a second shoulder with said first shoulder and said second shoulder being adapted to abut said opposite ends of said threaded coupling upon said three-element connection being tightened, said sucker rod tool system comprising:

a rod tongs having a first set of jaws adapted to engage said first set of flats of said first sucker rod and a second set of jaws adapted to engage said second set of flats of said second sucker rod while said threaded coupling threadingly engages said first sucker rod and said second sucker rod;

a drive unit coupled to rotate said second set of jaws relative to said first set of jaws, thereby applying a torque simultaneously to said first sucker rod and said second sucker rod with said threaded coupling interposed therebetween;

a first transducer adapted to provide a first feedback signal measuring an angular displacement of said first set of jaws relative to said second set of jaws;

a second transducer adapted to provide a second feedback signal that varies as a function of said torque applied to said first sucker rod and said second sucker rod; and a control responsive to said first feedback signal and said second feedback signal to help determine an extent to which said drive unit rotates said second set of jaws relative to said first set of jaws, thereby verifying a predetermined acceptable tightness between said first sucker rod and said threaded coupling and between said second sucker rod and said threaded coupling.

2. The sucker rod tool system of claim 1, wherein said control receives at least four samples of said first feedback signal and said second feedback signal with reference to each other to create a statistical sample of at least four data points and determines a calculated shoulder point based upon said statistical sample collectively, said drive unit rotating said second set of jaws a predetermined angular amount with reference to said calculated shoulder point and said first feedback signal.

3. The sucker rod tool system of claim 1, wherein said control repeatedly samples said first feedback signal and said second feedback signal with reference to each other to create a function to which a plurality of straight lines are fitted, and wherein said control distinguishes a properly tightened joint from an improperly tightened joint based upon the quantity of said plurality of straight lines.

4. The sucker rod tool system of claim 1, wherein said control determines whether both of said first sucker rod and said second sucker rod needs to be tightened into said threaded coupling by monitoring said second feedback signal in reference to said first feedback signal, whereby if said second feedback signal has a value below a predetermined minimum upon reaching a predetermined rotation of said first sucker rod beyond where said first shoulder and said second shoulder abut said opposite ends of said threaded coupling, then said drive unit rotates said second set of jaws further to tighten both said first sucker rod and said second sucker rod.

5. The sucker rod tool system of claim 1, wherein said control provides a dwell period during which said drive unit urges said second set of jaws to continue rotating a predetermined period of time after said first feedback signal has indicated that one of said first sucker rod and said second sucker rod has rotated a predetermined rotation beyond where one of said first shoulder and said second shoulder abutted one of said opposite ends of said threaded coupling, thereby accommodating a factor of wind exerting a cross-load upon at least one of said first sucker rod and said second sucker rod.

6. The sucker rod tool system of claim 1, wherein said control includes a memory that stores a target function, and wherein said control repeatedly samples said first feedback signal and said second feedback signal with reference to each other to create an actual function, whereby said control determines whether said three-element connection is properly tightened by comparing said actual function to said target function.

7. The sucker rod tool system of claim 1, further comprising an operator feedback system that provides at least one of an audio signal and a visual signal in response to said first feedback signal and said second feedback signal to distinguish between a properly tightened three-element connection and an improperly tightened three-element connection.

8. The sucker rod tool system of claim 1 for further use on a plurality of sucker rods adapted to be installed at a plurality of depths within a well bore, said sucker rod tool system further comprising: a record associated with said control and adapted to store a plurality of tightness values for said plurality of sucker rods and adapted to store said plurality of tightness values with reference to a plurality of addresses related to said plurality of depths, wherein said plurality of tightness values include at least one of said angular displacement and said torque.

9. The sucker rod tool system of claim 1 for further use on a plurality of sucker rods that are interconnected by a plurality of threaded couplings, are disposed at a plurality of depths within a well bore, and are about to be removed therefrom, said sucker rod tool system further comprising: a record associated with said control and adapted to store a plurality of breakaway values for said plurality of sucker rods and adapted to store said plurality of breakaway values with reference to a plurality of addresses related to said plurality of depths, wherein each of said plurality of breakaway values are a function of a work expenditure required to at least partially unscrew one of said plurality of sucker rods from one of said plurality of threaded couplings.

10. The sucker rod tool system of claim 9, wherein said work expenditure is a function of a disassembly torque and a disassembly angular displacement required to at least partially unscrew said one of said plurality of sucker rods from said one of said plurality of threaded couplings, wherein said disassembly angular displacement and said disassembly torque is provided by said second first transducer and said second transducer respectively.

11. The sucker rod tool system of claim 1 for further use at a well bore adapted to receive said three-element connection, said sucker rod tool system further comprising a sensor adapted to sense said three-element connection moving vertically, whereby said sensor is able to sense said three-dement connection moving downward toward said well bore and moving upward away from said well bore.

12. The sucker rod tool system of claim 11, wherein said sensor distinguishes between an upward movement and a downward movement of said three-element connection.

13. The sucker rod system of claim 1, wherein said drive unit includes a hydraulic motor with a housing, and said second transducer senses a hydraulic pressure contained directly within said housing.

14. The sucker rod system of claim 1, wherein said drive unit includes a hydraulic motor with a gear having a plurality of ferro-magnetic gear teeth, and said first transducer senses a magnetic disturbance created by each of said plurality of ferro-magnetic gear teeth moving past said first transducer as said gear rotates.

* * * * *